US008847710B2

(12) United States Patent
Lagorsse et al.

(10) Patent No.: US 8,847,710 B2
(45) Date of Patent: Sep. 30, 2014

(54) MICROWAVE FILTER WITH DIELECTRIC RESONATOR

(75) Inventors: Joël Lagorsse, Castanet Tolosan (FR); Damien Pacaud, Beaumont sur Leze (FR)

(73) Assignee: Thales, Neuilly sur Seine (FR)

( * ) Notice: Subject to any disclaimer, the term of this patent is extended or adjusted under 35 U.S.C. 154(b) by 439 days.

(21) Appl. No.: 13/251,223

(22) Filed: Oct. 1, 2011

(65) Prior Publication Data

US 2012/0081196 A1 Apr. 5, 2012

(30) Foreign Application Priority Data

Oct. 1, 2010 (FR) ..... 10 03899

(51) Int. Cl.
*H01P 1/20* (2006.01)
*H01P 7/10* (2006.01)
*H01P 1/208* (2006.01)

(52) U.S. Cl.
CPC ..... *H01P 1/2084* (2013.01); *H01P 7/10* (2013.01)
USPC ..... 333/202; 333/234

(58) Field of Classification Search
CPC ... H01P 1/2082; H01P 1/2084; H01P 1/2086; H01P 7/10; H01P 7/105
USPC ..... 333/202, 219.1, 229, 234, 235
See application file for complete search history.

(56) References Cited

U.S. PATENT DOCUMENTS

| | | | | |
|---|---|---|---|---|
| 4,639,699 | A | 1/1987 | Nishikawa et al. | |
| 6,049,261 | A * | 4/2000 | Thomson | 333/209 |
| 2011/0133862 | A1 | 6/2011 | Chun et al. | |

FOREIGN PATENT DOCUMENTS

| | | | |
|---|---|---|---|
| DE | 2851870 | A1 | 6/1980 |
| EP | 2031693 | A1 | 3/2009 |
| FR | 2534088 | A1 | 4/1984 |
| WO | 2006/058965 | A1 | 6/2006 |
| WO | 2010/016746 | A2 | 2/2010 |

* cited by examiner

*Primary Examiner* — Benny Lee
*Assistant Examiner* — Gerald Stevens
(74) *Attorney, Agent, or Firm* — Baker & Hostetler LLP

(57) ABSTRACT

A filter of longitudinal axis Z includes: at least one resonant cavity delimited by walls made of a material that has a non-zero expansion coefficient; a dielectric resonator mounted in the cavity transversally to the axis Z; a mechanical device for compensating at least one resonance frequency of the cavity as a function of the temperature. The compensation device comprises: at least one rotationally mobile finger for each mode and for each cavity, the mobile finger penetrating to a fixed depth into the cavity via a pivot link, and an external mechanical actuator mounted parallel to the axis Z and mechanically coupled to the mobile finger, the external mechanical actuator being made of a material that has a coefficient of thermal expansion at least five times lower than that of the walls of the filter.

14 Claims, 12 Drawing Sheets

MICROWAVE FILTER WITH DIELECTRIC RESONATOR

CROSS-REFERENCE TO RELATED APPLICATION

This application claims priority to foreign French patent application No. FR 1003899, filed on Oct. 1, 2010, the disclosure of which is incorporated by reference in its entirety.

FIELD OF THE INVENTION

The present invention relates to a microwave filter with dielectric resonator. It applies to the field of microwave filtering in which the filter comprises at least one dielectric resonator which is not temperature compensated or is partially temperature compensated and more particularly to the signal filtering devices.

BACKGROUND

A filter with dielectric resonator comprises at least one resonant cavity in which is installed a dielectric resonator and RF microwave energy coupling means making it possible to introduce RF energy at the input of the filter and to extract RF energy at the output of the filter. This type of filter can be excited only in a relatively narrow frequency band around the resonance frequency of the resonator which is generally adjusted by frequency tuning means.

However, the resonant cavities are subject to temperature variations, linked to the thermal environment and to the dissipated RF power, which provoke dimensional variations of thermoelastic origin and induce a shift in their resonance frequency. To remedy this major drawback, a first solution consists in using a dielectric resonator made of a dielectric material, of ceramic type, consisting of a mixture of a base material and one or more additional temperature compensation materials. Now, these additional materials introduce significant insertion losses which limit their use for the filtering of signals in high-power applications, such as, for example, in the output multiplexers of Omux type.

Another solution consists in using a dielectric resonator made of a dielectric material that is not temperature compensated, this material being able, for example, to consist of a base material of ceramic type such as, for example, alumina, the base material not having any additional compensation material. In this case, to enable the filter to overcome the temperature variations linked to both the thermal environment and the dissipated RF power, the filter can be fitted with a mechanical compensation device which makes it possible to dynamically control the resonance frequency of the cavity.

There are many mechanical compensation devices for a filter, such as, for example, in a first variant of the technological family, devices that use means for deforming an end wall called cap, or, in a second variant of the technological family, devices that use a translationally mobile part which passes through the wall of the filter and penetrates to a greater or lesser depth according to the temperature inside the cavity so as to control and stabilize the resonance frequency. However, since the compensation systems deriving from the first technological variant have to be mechanically coupled to the caps of the filter, they are suited to a filter topology with lateral input/output and cannot be applied to a filter with dielectric resonator in which the input and the output of the filter are axial. Moreover, in the second technological variant, since the mobile part has to slide in a hole situated on the body of the filter to be depressed in or withdrawn, the presence of a play that is necessary for the sliding requires implementing internal devices such as RF barriers or conductive flexible jackets, in order to provide the requisite RF performance levels in terms of or power behaviour losses, or even to overcome any electrical discontinuity effect.

SUMMARY OF THE INVENTION

The aim of the invention is therefore to provide a technical response to these various constraints and to produce a microwave filter with dielectric resonator that includes a mechanical compensation system which makes it possible to control the resonance frequency of the cavity as a function of the temperature, which is suited to an axial topology of the filter and which does not have any electrical discontinuity at the level of the wall of the filter.

For this, the invention relates to a microwave filter with dielectric resonator that has a longitudinal axis Z, comprising:

- at least one resonant cavity according to at least one resonance mode and at least one resonance frequency, the cavity being delimited by at least one longitudinal wall and transversal walls, said longitudinal and transversal walls being made of a material that has a non-zero expansion coefficient,
- a dielectric resonator mounted in the cavity transversally to the axis Z, the dielectric resonator not being temperature compensated or being partially temperature compensated,
- a mechanical device for compensating the resonance frequency of the cavity as a function of the temperature, the mechanical compensation device comprising:

- at least one rotationally mobile finger for each resonance mode, the mobile finger being provided with a plunger penetrating into the cavity to a fixed depth and at a distance D from the resonator, the distance D being defined at ambient temperature and being temperature-variable,
- at least one pivot link formed in the longitudinal wall, the plunger penetrating into the cavity via the pivot link,
- and an external mechanical actuator for controlling the rotation of the mobile finger by pivoting around the pivot link, the actuator being made of a material that has a coefficient of thermal expansion at least five times lower than that of the walls of the filter and being mounted parallel to the axis Z at a non-zero height H from the longitudinal wall of the filter and mechanically coupled to an external top part of the mobile finger.

The microwave filter according to the invention may have other complementary characteristics which can be taken separately and/or in combination, and notably:

- the mobile finger advantageously has an angle of rotation which is a function of the temperature and of the coefficient of thermal expansion difference between the material of the actuator and the material of the longitudinal wall of the filter;
- the mobile finger may have a top part mounted to abut on a locally thinned region of the longitudinal wall of the filter, the locally thinned region forming the pivot link for the mobile finger;
- the mobile finger may have a top part mounted to abut on a conductive flexible insert formed in the longitudinal wall of the filter and connected to the mobile finger and to the longitudinal wall, the insert forming the pivot link for the mobile finger;
- according to one embodiment, the filter has a single resonant cavity and the external mechanical actuator is advantageously mechanically coupled, at two attachment points, to the external top part of the mobile finger and to one of the walls of the filter;

according to another embodiment, the filter has at least two resonant cavities superposed along the longitudinal axis Z and coupled together, and two dielectric resonators respectively mounted in the cavities, the compensation device has at least two mobile fingers aligned parallel to the axis Z, each mobile finger being provided with a plunger respectively penetrating into the cavities to a fixed depth and at one and the same distance D from the respective dielectric resonators, and the external mechanical actuator is advantageously mechanically coupled to the external top part of the two mobile fingers at two attachment points;

according to another embodiment, the filter has at least two resonant cavities superposed along the longitudinal axis Z and coupled together, and two dielectric resonators respectively mounted in the cavities, the compensation device has at least two mobile fingers aligned parallel to the axis Z, each mobile finger being provided with a plunger penetrating respectively into the cavities to a fixed depth and at one and the same distance D from the respective dielectric resonators, and the device for compensating frequency variations as a function of the temperature advantageously also includes an additional longitudinal part made of a material that has the same coefficient of thermal expansion as that of the walls of the filter, the additional longitudinal part being mounted parallel to the external mechanical actuator and fixed to the external top part of the two mobile fingers, the external mechanical actuator being fixed to one of the walls of the filter, and the actuator and the additional longitudinal part are mechanically coupled together at a single local fixing point;

advantageously, the local fixing point has an adjustable longitudinal position;

advantageously, the external mechanical actuator is fixed to one of the transversal walls of the filter;

advantageously, the filter includes a height H adjustment system to adjust the temperature-variable rotation angle of the plungers and therefore the compensation;

according to another embodiment, the filter may have at least two mobile fingers inserted into the resonant cavity, the two mobile fingers being distributed angularly through the longitudinal wall of the filter, and may also have at least one insert arranged in the resonant cavity coupling the plungers of the two mobile fingers inserted into the resonant cavity;

the mobile finger may be a single-piece part or have two distinct metal parts or have two distinct parts, respectively metal and dielectric.

BRIEF DESCRIPTION OF THE DRAWINGS

Other features and advantages of the invention will become clearly apparent hereinafter in the description given as a purely illustrative and nonlimiting example, with reference to the appended schematic drawings which represent.

DETAILED DESCRIPTION

Figure 1:
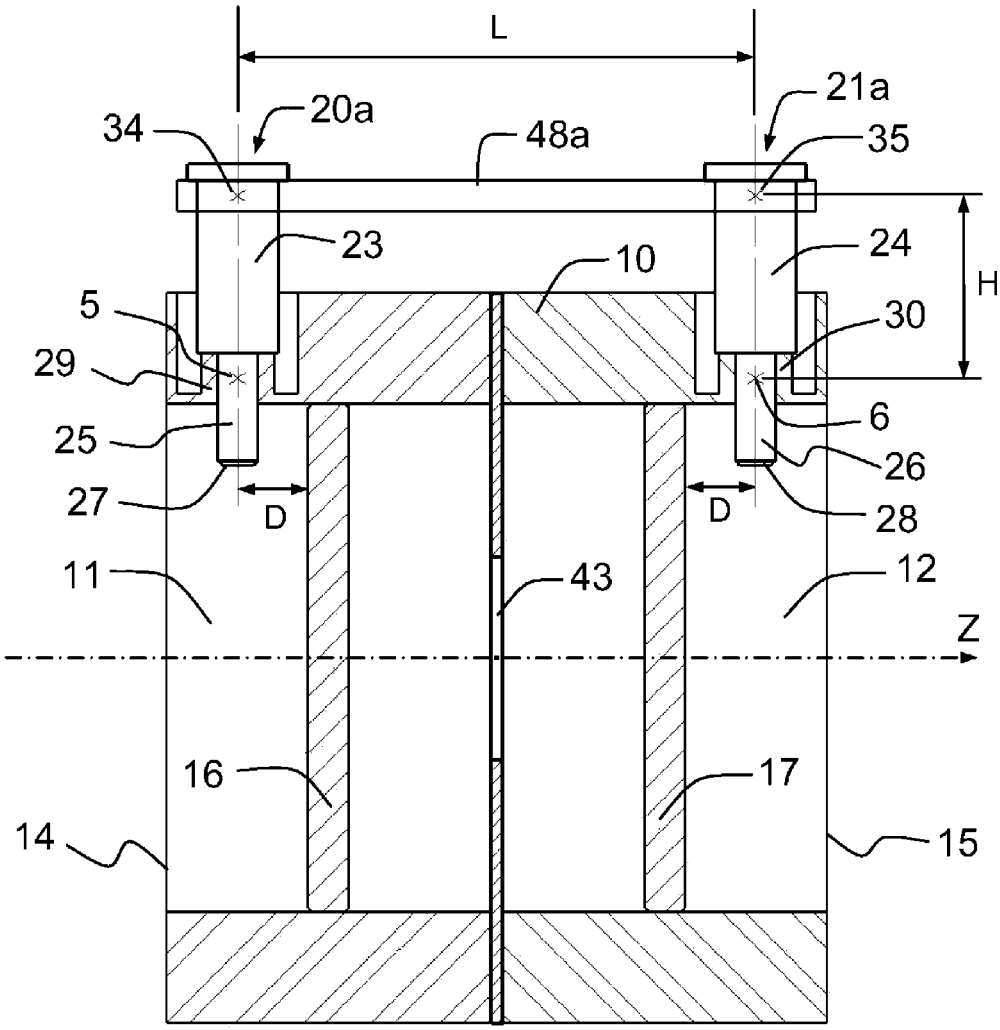
FIG. 1: a diagram in longitudinal cross section of an exemplary microwave filter with dielectric resonator including an exemplary mechanical temperature compensation device at rest, according to a first embodiment of the invention.

The filter represented schematically in the various figures has one or more peripheral longitudinal walls 10 having a geometry defined around a longitudinal axis Z, forming a waveguide, for example with cylindrical, rectangular, square or elliptical section, and delimiting at least one resonant cavity, and two opposite transversal end walls 14, 15 respectively including an axial input and an axial output for microwave signals. The longitudinal and transversal walls of the filter are made of a metallic material such as, for example, aluminium. As a nonlimiting example, two resonant cavities 11, 12 are represented in FIGS. 1 to 7, the two resonant cavities 11, 12 being superposed along the longitudinal axis Z and coupled together by a coupling iris diaphragm 43. Each resonant cavity 11, 12 has a dielectric resonator 16, 17 which may be of any shape. As a nonlimiting example, as represented in the various figures, the dielectric resonator 16, 17 may be produced using "plate" technology and have two mutually parallel flat faces separated by a thickness of dielectric delimited by lateral walls. In this case, each dielectric resonator 16, 17 may be, for example, placed transversally to the axis Z, substantially in the middle of the two respective cavities 11, 12 and attached to the longitudinal wall 10 of the filter so that each resonator is electrically coupled to the walls of the filter. The electrical coupling of each resonator to the walls of the filter may, for example, be provided by a mechanical and electrical contact with the longitudinal wall 10 of the filter. The filter also has at least one mechanical device for compensating the resonance frequency of the filter comprising at least one rotationally mobile finger for each operating mode and for each cavity and an external mechanical actuator coupled to the mobile finger. The mobile finger is mounted in the longitudinal wall 10 of the filter and penetrates into the cavity. In the first exemplary embodiment of FIG. 1, the mechanical resonance frequency compensation device has two mobile fingers 20*a*, 21*a* respectively dedicated to the cavities 11, 12, aligned parallel to the axis Z and coupled together, each mobile finger having an external top part 23, 24 and a bottom part 25, 26, called plunger, which passes, substantially perpendicularly, through the longitudinal wall 10 of the filter and penetrates respectively into one of the cavities of the filter to a predetermined fixed depth. When at rest, the plungers 25, 26 are respectively positioned at one and the same relative position, corresponding to one and the same distance D, from the respective resonators 16, 17, the distance D corresponding to a distance at ambient temperature. The top part 23, 24 of each mobile finger may, for example, be mounted to abut on the longitudinal wall 10 of the filter. The mobile fingers may be produced in a metallic single-piece part of the same material as or different material from the walls of the filter, or produced in two distinct parts. In the case where the mobile fingers have two distinct parts, their bottom part 25, 26 may be made of a dielectric material or of a metallic material that is identical to or different from that of the top part. The metallic top parts 23, 24 of the two mobile fingers are linked in a fixed manner to one and the same external actuator 48*a*, the actuator 48*a* being made of a material that has a coefficient of thermal expansion CTE which is significantly lower, for example at least five times lower, and preferably at least ten times lower, than that of the material of the longitudinal wall 10 of the filter. As a nonlimiting example, the actuator 48*a* may, for example, be made of a material such as Invar (registered trademark) and the material of the longitudinal wall 10 of the filter may be made of aluminium. Each mobile finger may, for example, have two coaxial parts with symmetry of revolution, for example cylindrical, respectively forming the internal and external parts, the internal part penetrating on its own into the cavity having a diameter less than the external part linked to the external actuator 48*a* and to the longitudinal wall 10 of the filter. At the point where a mobile finger 20*a*, 21*a* passes through the longitudinal wall 10 of the filter, the wall 10 may have a locally thinned region 29, 30 forming a flexible metallic membrane that can be deformed at the level of the link between the mobile finger 20*a*, 21*a* and the respective cavity 11, 12. The locally thinned regions form the abutments on which the external parts of the mobile fingers rest and form pivot links for the mobile fingers. The thinned region may be replaced by a conductive flexible insert, not represented, formed in the longitudinal wall of the filter, connected to the mobile finger and to the wall of the cavity, the insert then providing the pivot link function and an electrical continuity into the cavity.

Figure 2:
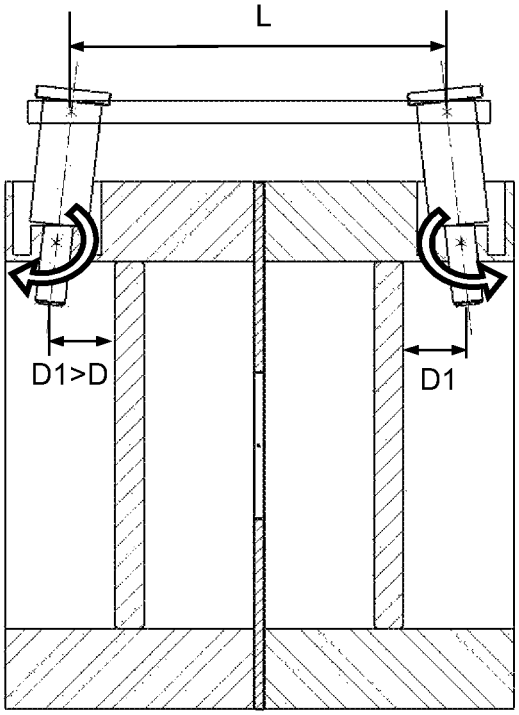
FIG. 2: a diagram of the filter of FIG. 1 when the temperature increases, according to the invention.
Figure 3:
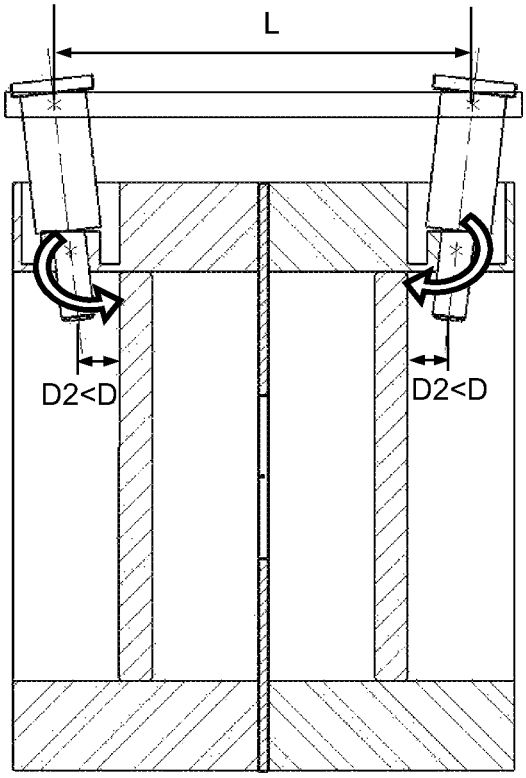
FIG. 3: a diagram of the filter of FIG. 1 when the temperature decreases, according to the invention.

Since the two cavities 11, 12 are coupled together, they need to have a similar behaviour and operate at the same resonance frequency. This resonance frequency is finely set at ambient temperature, for example, as represented in FIGS. 4 to 9, by a set of screws 31 passing through the walls of the filter and penetrating into each cavity 11, 12. In operation, the walls of the filter have dimensions which vary with the temperature which causes the resonance frequency of the cavities of the filter to vary. To stabilize the value of the resonance frequency of each cavity when the temperature of the filter changes, the mechanical compensation device dynamically modifies, by one and the same value, the distance D which separates the end 27, 28 of the plunger of each mobile finger and the resonator 16, 17 positioned in the corresponding cavity 11, 12. With the external part 23, 24 of each mobile finger 20*a*, 21*a* remaining fixed in abutment on the local thinned regions 29, 30 of the longitudinal wall 10 of the filter, this ensures a permanent electrical continuity for the walls of the filter. The modification of the distance D is obtained by virtue of the differential in the coefficients of thermal expansion which exists between the material of the actuator and the material of the walls of the filter and of the external parts of the mobile fingers. By the effect of this differential, the external actuator induces, by temperature, mechanical forces on the plungers, perpendicularly to the axis of the plungers, which provokes a simultaneous pivoting of the two plungers by rotation about the two respective pivot links 5, 6 situated at the level of the local thinned regions 29, 30 of the wall 10 which are deformed under the action of this pivoting. FIGS. 2 and 3 schematically illustrate the operation of the mechanical compensation device respectively when the temperature in the cavity increases and when it decreases.

In the embodiments represented in FIGS. 1 to 7, the external actuator 48*a* is a longitudinal part arranged longitudinally in proximity to the longitudinal wall 10 of the filter, at a non-zero height H relative to the thinned regions 29, 30 of the wall 10 of the filter, and parallel to the axis Z of the filter. The external actuator 48*a* is mechanically coupled, at two attachment points 34, 35 situated at the height H and spaced apart by a distance L, to two distinct mobile fingers 20*a*, 21*a*. The height H can be set by any appropriate means such as, for example, by a set of shims 32, 33, these shims being able, for example, to be made of a peelable material, which then makes it possible to be able to finely set the height H. The setting of the height H can also be done by another system such as a set of screws associated with nuts.

Since the walls of the filter are metallic, its dimensions expand when the temperature increases. Since the external actuator 48*a* is made of a material that has a coefficient of thermal expansion much lower than that of the walls of the filter, it is virtually temperature-stable and the distance L separating the two attachment points 34, 35 remains virtually fixed. Under the action of the expansion of the walls of the filter, the actuator 48*a* therefore retains the external part of the mobile fingers at the level of their attachment point 34, 35 at the height H and prevents this external part, at the level of the attachment points 34, 35, from following the movement of the walls of the filter. Each plunger 25, 26, mounted to abut on the thinned regions of the wall of the filter, then pivots in rotation about their respective pivot link 5, 6 and it inclines by deforming the thinned regions 29, 30 of the wall of the filter. In the embodiment of FIG. 2, the rotational pivoting of the plungers about their respective pivot link 5, 6 and their inclination is performed symmetrically in a direction opposite to one another and has the effect of distancing the ends of the fingers of the plungers from the respective resonators, the distance D1 between each resonator and the end 27, 28 of each plunger

25, 26 being greater than the distance D when at rest. The maximum amplitude of the angle of rotation of the plungers is, partly, linked to the height H. When the height H increases, the maximum amplitude of the angle of rotation of the plungers decreases, which results in a decrease in the possible compensation. In this first embodiment of the invention, the setting of the height H is therefore a means for setting the compensation for the frequency variation as a function of temperature.

As schematically represented in FIG. 3, in the contrary case in which the temperature decreases, the dimensions of the walls of the cavity decrease and the rotational pivoting of the plungers about their respective pivot link 5, 6 is performed symmetrically in a direction opposite to one another but has the effect of bringing the end of the plunger of each mobile finger closer to the respective resonators, the distance D2 between each resonator and the end 27, 28 of each plunger 25, 26 being less than the distance D when at rest. The distance by which the end of the plungers moves away from or closer to the respective resonators is of the order of a few micrometers, which makes it possible to dynamically control the resonance frequency of each cavity. Since the compensation device is symmetrical and the two plungers operate symmetrically, the compensation for the frequency variation as a function of temperature is identical for each cavity which makes it possible for the two cavities 11, 12 to operate at the same resonance frequency.

Figure 4:
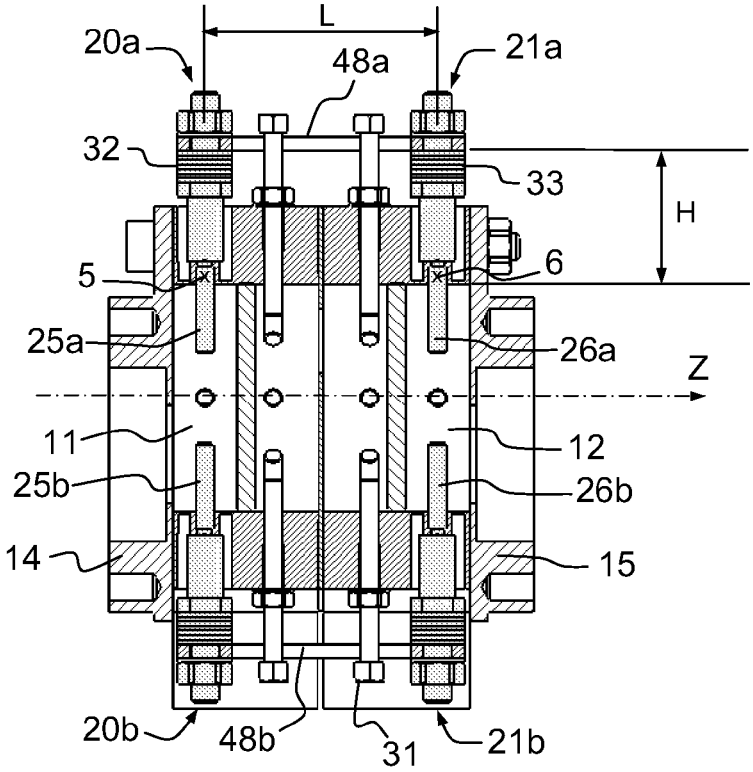
FIGS. 4 and 5: a diagram in longitudinal cross section of an exemplary microwave filter with dielectric resonator including a second exemplary mechanical temperature compensation device respectively at rest and in operation, according to the first embodiment of the invention.
Figure 5:
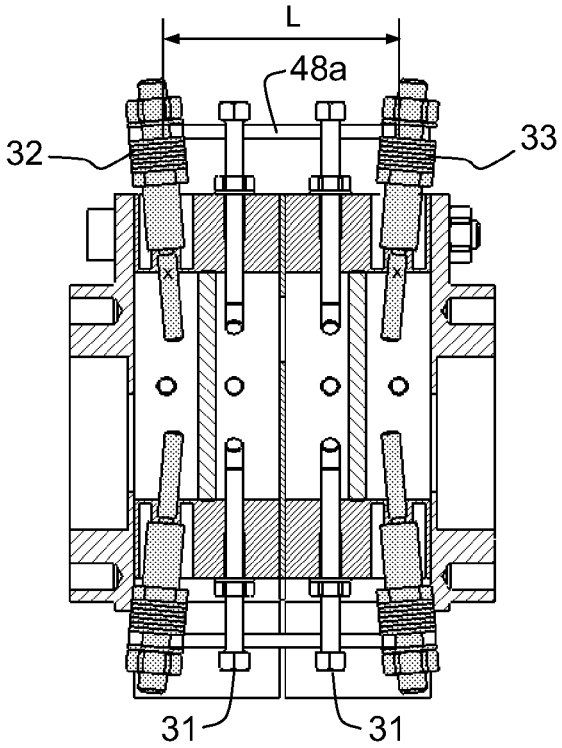

The temperature compensation system includes at least one plunger for each operating mode and for each cavity. It may be necessary to have a number of plungers for each cavity when the maximum rotation amplitude of a single plunger is insufficient and does not make it possible to obtain a desired frequency compensation capability. In FIGS. 4 and 5, the temperature compensation system of the filter has two plungers for each cavity. The two plungers associated with one and the same cavity are angularly spaced apart from one another in a diametrically opposite fashion and act on one and the same operating mode, which makes it possible to distribute the compensation effect. The two plungers 25*a*, 25*b*, respectively 26*a*, 26*b*, associated with two different mobile fingers 20*a*, 20*b*, respectively 21*a*, 21*b*, plunge into one and the same cavity 11, respectively 12, of the filter. Each plunger 25*a*, 25*b* of the first cavity 11 is coupled in line to a corresponding plunger 26*a*, 26*b* of the second cavity 12 via a respective actuator 48*a*, 48*b*. Thus, with two plungers for each cavity, the possible compensation is two times greater than with a single plunger for each cavity.

In the views of FIGS. 6 to 9, the compensation system has four mobile fingers for each cavity. The four mobile fingers 20*a*, 20*b*, 20*c*, 20*d* are angularly distributed in a regular manner through the longitudinal wall 10 of the filter. The internal part 25 of each mobile finger forming a plunger in the cavity 11, is positioned in front of a face of a plate resonator 16. The cavity 11 represented is bi-mode, each operating mode being tuned to the same frequency. The plungers 25*a*, 25*b*, corresponding to the mobile fingers 20*a*, 20*c*, are arranged in a diametrically opposite fashion and act on one and the same first mode. The plungers 25*c*, 25*d*, corresponding to the mobile fingers 20*c*, 20*d*, are positioned at 90° relative to the plungers 20*a*, 20*b* and act on one and the same second mode.

When the cavities operate in two different modes, as represented in FIGS. 6 to 9, it is necessary to compensate the temperature drifts for the two operating modes. For this, each mobile finger 20*a*, 20*b*, 20*c*, 20*d* is actuated pivoting-wise by an external actuator 48*a*, 48*b*, 48*c*, 48*d* fixed at a height H on the external part 23 of the corresponding mobile finger.

The end 27 of each plunger 25*a*, 25*b*, 25*c*, 25*d* may be of diverse form and of any dimension, this form being adjusted so as to act optimally on the electric field prevailing in the cavity of the filter and to optimize the frequency compensation. With the electrical field being maximum in the dielectric resonator, the rotation of the plunger toward the dielectric resonator causes a strengthening of the electrical field which causes the resonance frequency of the cavity to be lowered. Conversely, the rotation of the plunger in the direction opposite to the resonator increases the resonance frequency. The frequency shift depends not only on the length of the plunger but also on its shape which can be optimized according to the map of the electromagnetic field to have the desired effect with less effort, fewer parts and lower losses.

Figure 6:
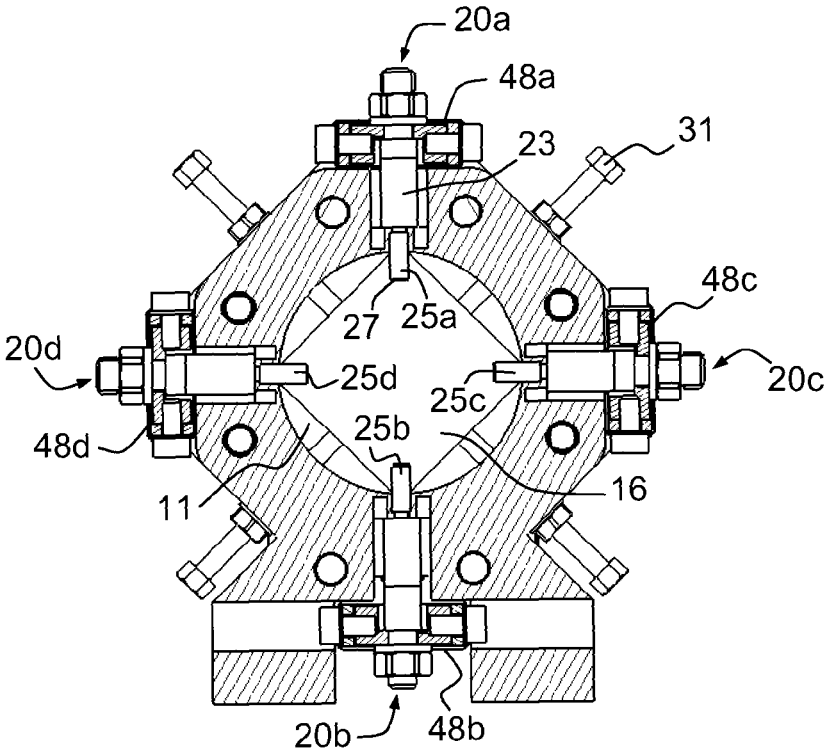
FIG. 6: a diagram in transversal cross section of an exemplary bi-mode microwave filter equipped with a mechanical temperature compensation device, according to the first embodiment of the invention.
Figure 7:
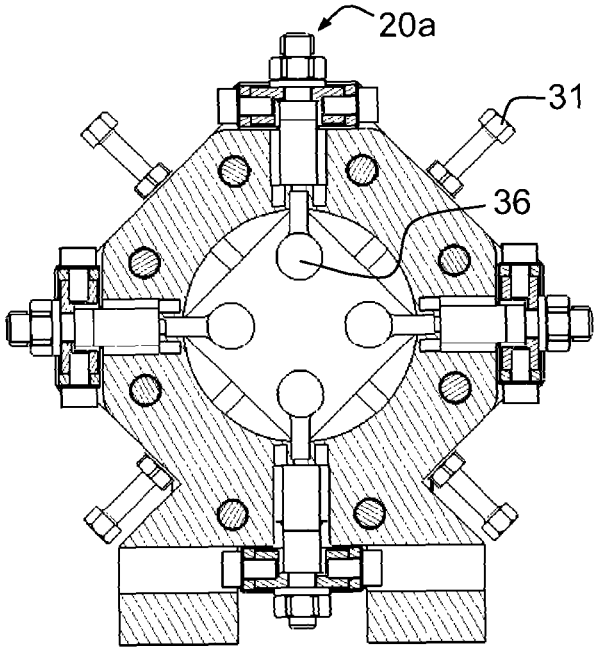
FIG. 7: a diagram in transversal cross section of an exemplary bi-mode microwave filter that has plungers with circular end piece, according to the first embodiment of the invention.
Figure 8:
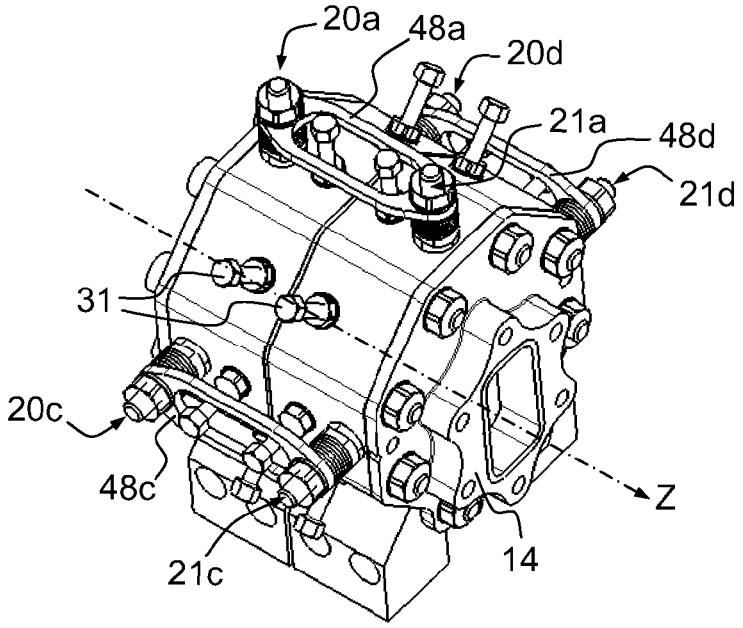
FIGS. 8 and 9: two perspective diagrams of the microwave filter of FIGS. 6 and 7, according to the invention.
Figure 9:
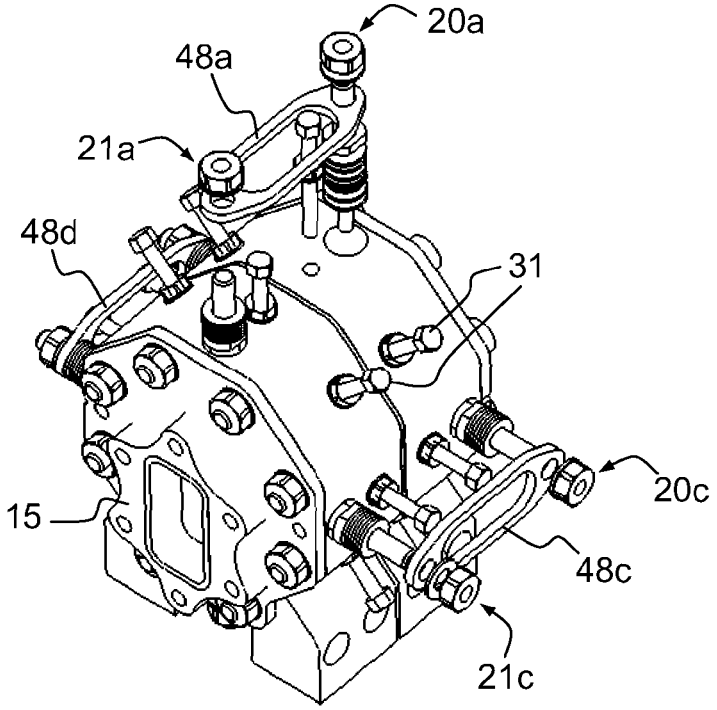

By way of nonlimiting examples, in FIG. 6, the end 27 of each plunger has a straight shape whereas, in FIG. 7, the end of each plunger consists of a circular end piece 36. The end piece 36 may also be of cylindrical shape, or have a round or square or rectangular paddle.

Figure 10:
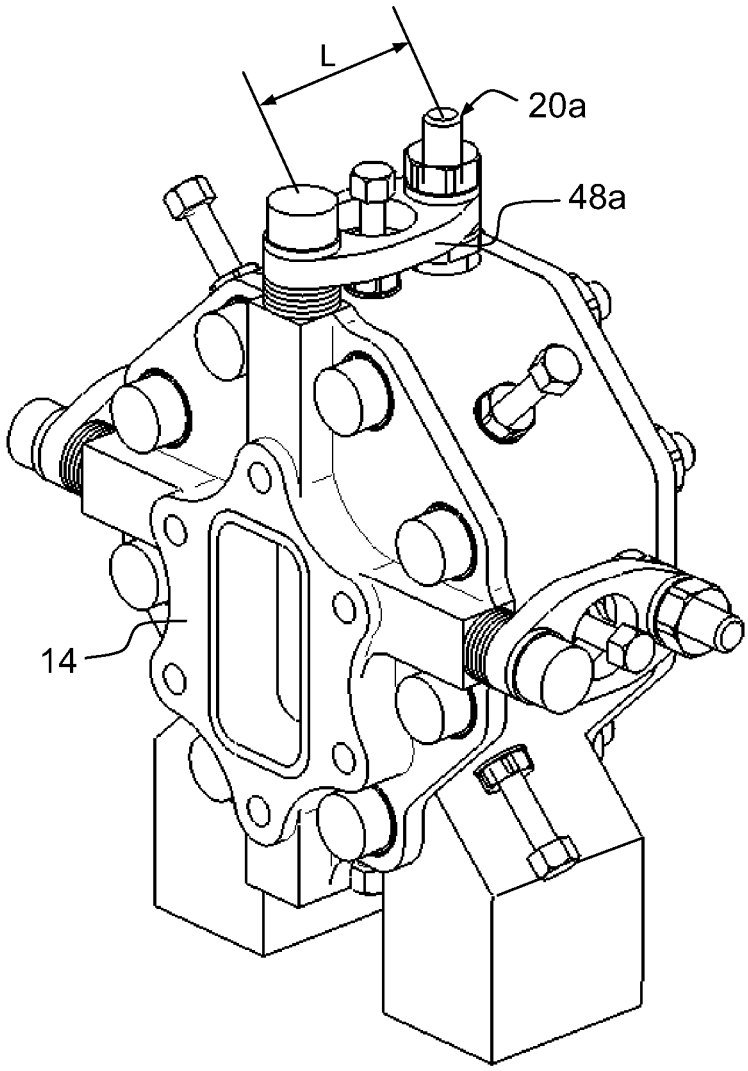
FIGS. 10 and 11: two diagrams, in transversal cross section and in profile, of an exemplary single-cavity filter provided with a mechanical temperature compensation system according to a variant embodiment of the invention.
Figure 11:
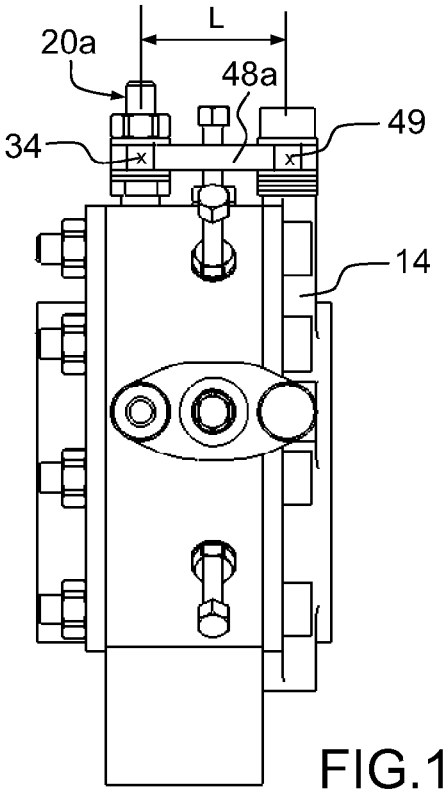

In the exemplary embodiment represented in FIGS. 10 and 11, the filter has a single resonant cavity and a compensation system with at least one mobile finger 20*a* plunging into the cavity. In this case, since the cavity is unique, the compensation system does not have a number of aligned mobile fingers which can be connected together by the external actuator 48*a* of the compensation system. The external actuator is then mechanically coupled, at two attachment points 34, 49 situated, at the height H and spaced apart by a distance L, at the external top part 23 of the mobile finger 20*a* and at one of the walls 10, 14, 15 of the filter, preferably at one of the transversal end walls 14, 15 of the filter.

Figure 12:
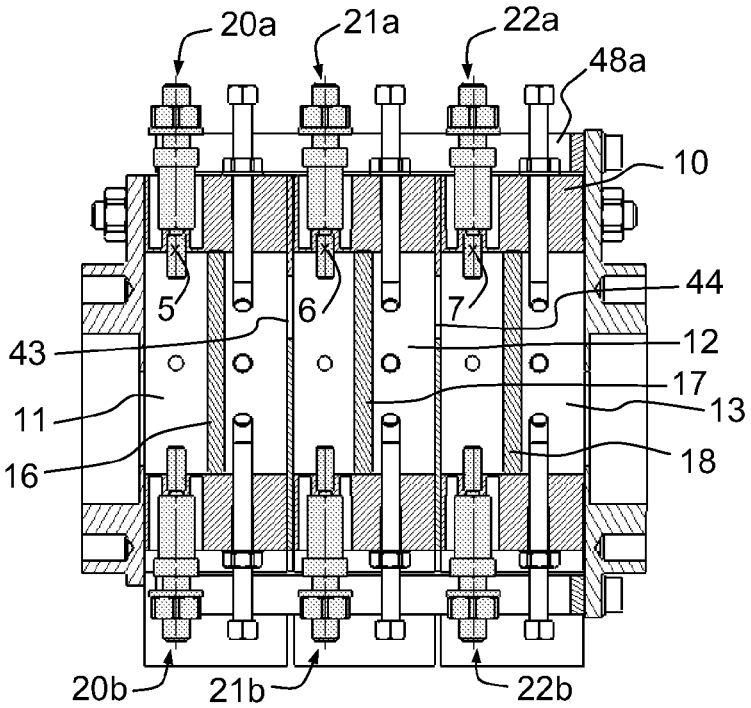
FIG. 12: a diagram in longitudinal cross section of an exemplary microwave filter with dielectric resonator including an exemplary mechanical temperature compensation device at rest, according to a second embodiment of the invention.
Figure 13:
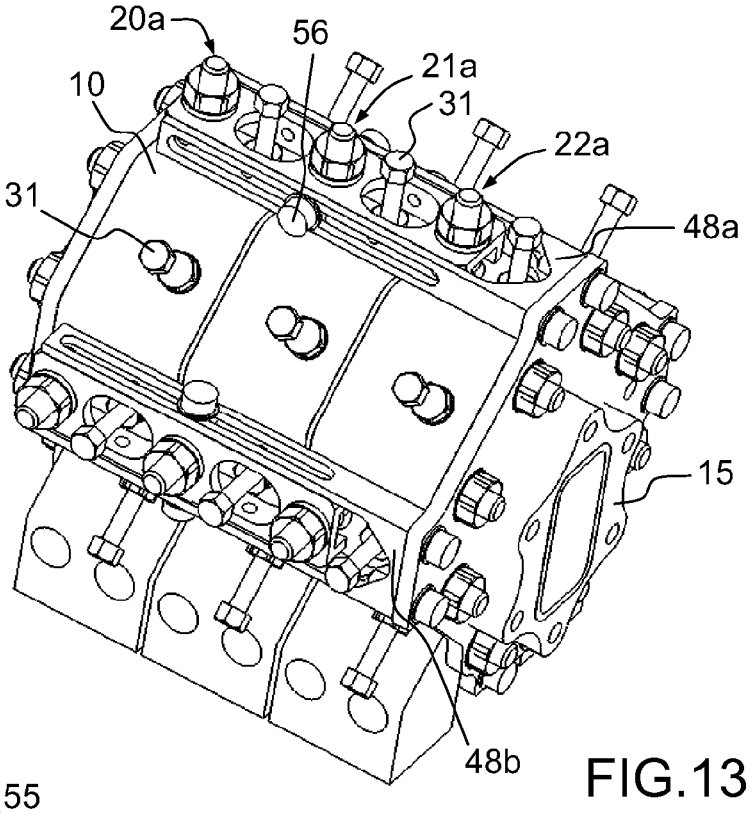
FIG. 13: a perspective diagram of the microwave filter of FIG. 10 showing the compensation device mounted on the filter, according to the invention.
Figure 14:
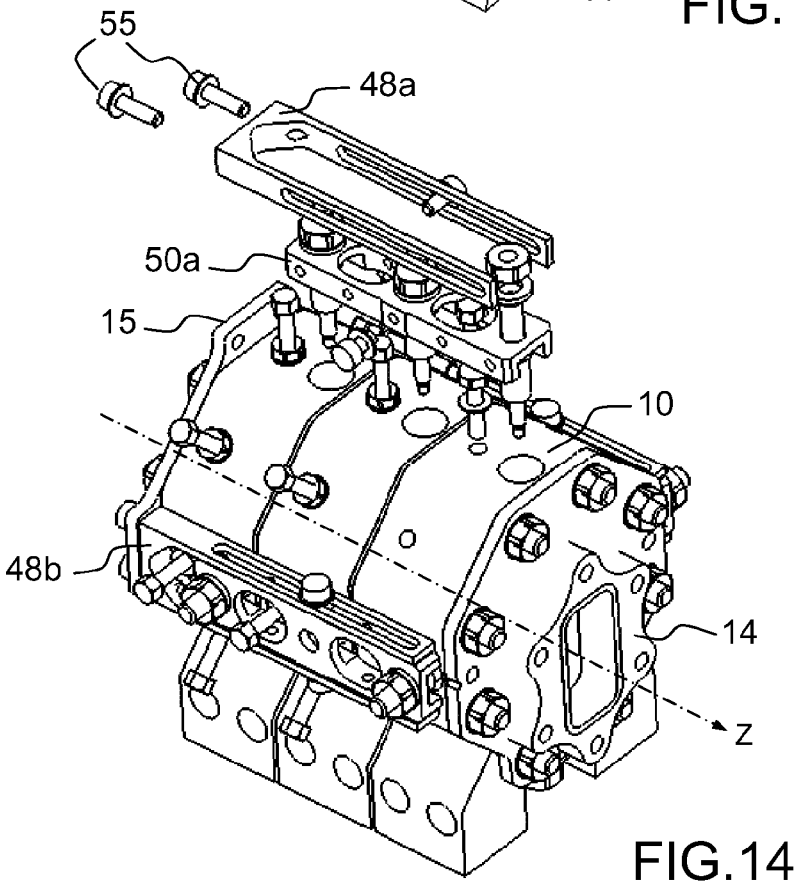
FIG. 14: a perspective diagram of the microwave filter of FIG. 10 showing, in exploded form, the various parts of the compensation device, according to the invention.

In the exemplary embodiment represented in FIGS. 12 to 14, the filter has three resonant cavities 11, 12, 13 superposed along the longitudinal axis Z. The three resonant cavities 11, 12, 13 are coupled together by two coupling iris diaphragms 43, 44. Each resonant cavity respectively has a dielectric resonator 16, 17, 18 placed transversally to the axis Z, substantially in the middle of the respective three cavities 11, 12, 13 and attached to the longitudinal wall 10 of the filter so that each resonator is electrically coupled to the walls of the filter. The filter has a device for compensating frequency variations as a function of temperature according to a second embodiment of the invention. The compensation device has at least one mobile finger 20*a*, 21*a*, 22*a* for each cavity, the mobile finger 20*a* being mechanically coupled to an external actuator 48*a* arranged parallel to the longitudinal axis Z in proximity to the longitudinal wall 10 of the filter. When the filter has a number of resonant cavities and the compensation device has a single plunger for each cavity, the plungers dedicated to the different cavities are coupled together in line via one and the same external actuator. In FIGS. 12 to 14, the filter has three mobile fingers 20*a*, 21*a*, 22*a* respectively dedicated to each of the three cavities, coupled together in line by a first external actuator 48*a* and three additional mobile fingers 20*b*, 21*b*, 22*b* coupled together in line by a second external actuator 48*b*.

As represented in the schematic view of FIG. 14, according to the second embodiment of the invention, the device for compensating frequency variations as a function of temperature also has an additional longitudinal part 50*a* mounted parallel to each actuator 48*a*. The additional part 50*a* is made of a metallic material that has the same coefficient of thermal expansion as that of the wall of the filter and is mechanically fixed to the top parts of the three mobile fingers 20*a*, 21*a*, 22*a* arranged on one and the same line parallel to the axis Z. The actuator 48*a* is made of a temperature-stable material that has a coefficient of thermal expansion CTE significantly lower than that of the material of the longitudinal wall 10 of the filter, for example made of Invar (registered trademark) and is mounted around the additional longitudinal part 50*a*, so that the additional longitudinal part 50*a* is housed with a play inside the actuator 48*a*. The actuator 48*a* and the additional longitudinal part 50*a* are therefore nested in one another and form an assembly arranged longitudinally outside the filter, along the longitudinal wall 10 of the filter and parallel to the axis Z.

The actuator 48*a* is mechanically coupled, at a fixing point Z1, to one of the walls 10, 14, 15 of the filter, preferably to one of the transversal end walls 14, 15, by a first fixing device 55, and is mechanically coupled to the aligned mobile fingers 20*a*, 21*a*, 22*a*, via the additional longitudinal part 50*a*. The actuator 48*a* and the additional longitudinal part 50*a* are also mechanically coupled together at a single local fixing point Z2 by a second fixing device 56. The local fixing point Z2 has an adjustable longitudinal position and may, for example, be situated between the two transversal end walls 14, 15 of the filter. The longitudinal part 50*a* is therefore fixed only to the mobile fingers and to the actuator 48*a* at the point Z2. The first and second fixing devices 55, 56 may comprise, for example, a screw assembly. The plungers of the three mobile fingers 20*a*, 21*a*, 22*a* penetrate respectively into each of the cavities of the filter, to one and the same fixed depth.

Figure 15A:
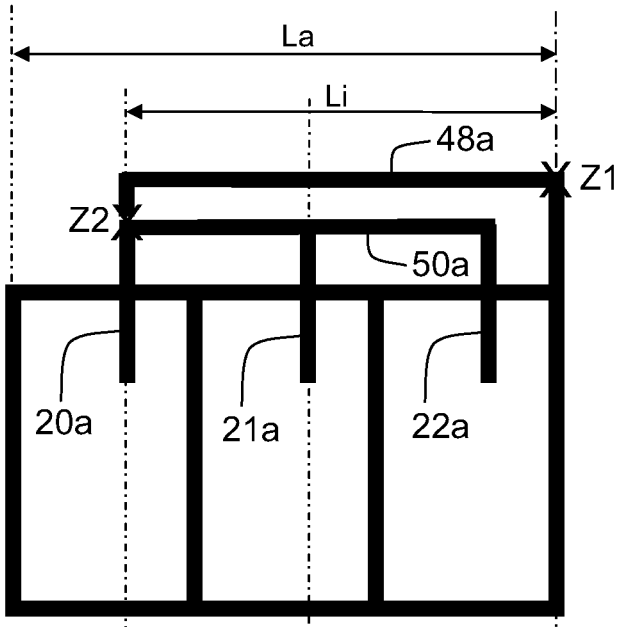
FIGS. 15*a* and 15*b*: two diagrams, respectively at rest and when the temperature increases, explaining the operation of the compensation device of the filter of FIG. 12 for a first value of the distance separating the fixing points Z1 and Z2 of the two parts of the actuator, according to the invention.
Figure 15B:
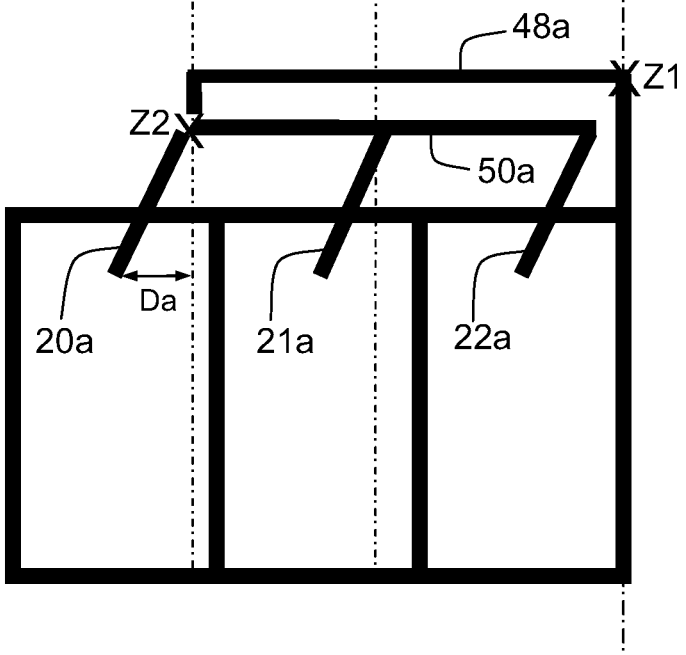
Figure 16A:
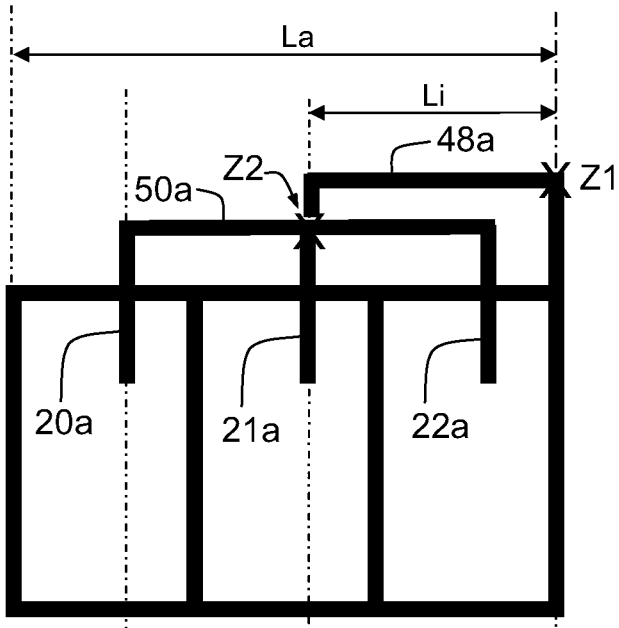
FIGS. 16*a* and 16*b*: two diagrams, respectively at rest and when the temperature increases, explaining the operation of the compensation device of the filter of FIG. 12 for a second value of the distance separating the fixing points Z1 and Z2 of the two parts of the actuator, according to the invention.
Figure 16B:
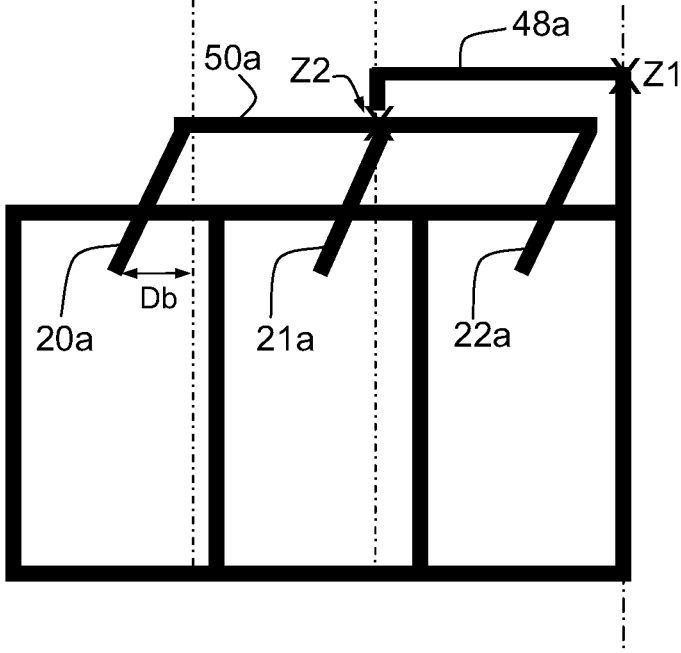

The operation of the compensation device is schematically represented in FIGS. 15*a*, 15*b* and 16*a*, 16*b* in which the fixing point Z1 is situated on the transversal end wall 15 of the filter. In FIGS. 15*a* and 15*b*, the fixing point Z2 is situated at the level of the mobile finger 20*a*. In FIGS. 16*a* and 16*b*, the fixing point Z2 is situated at the level of the mobile finger 21*a*. In practice, a number of intermediate positions for the fixing point Z2 may be predefined all along the additional part 50*a*, for example by tapped holes distributed along the part and capable of receiving the screw 56. When the temperature increases, the walls of the filters and the additional longitudinal part 50*a* expand and the length La of the longitudinal wall 10 increases whereas the actuator 48*a* which is made of a temperature-stable material is virtually unaffected, or affected very little, by the temperature variations and retains a fixed length Li. The portion of the additional longitudinal part 50*a* situated between the two fixing points Z1 and Z2 is then constrained by the actuator 48*a* which prevents it from moving. Under the effect of the expansion differential between the actuator 48*a* and the walls of the filter, the mobile fingers then incline about their respective pivot link 5, 6, 7, the different pivot links being situated at the level of the thinned regions of the longitudinal wall 10 of the filter on which the external ends of the plungers respectively abut. The inclination of the plungers of each mobile finger is performed by one and the same angle and in one and the same direction. The distance Z1-Z2 which separates the two fixing points Z1 and Z2 determines the displacement distance Da, Db of the ends of each plunger.

Thus, in FIG. 15*a*, the distance Z1-Z2 is greater than that represented in FIG. 16*a*, and in FIG. 15*b*, the distance Da of displacement of the ends of the plungers of each mobile finger is greater than the distance Db of displacement of the ends of each plunger represented in FIG. 16*b*. The embodiment represented in FIGS. 16*a* and 16*b* makes it possible to set the compensation by an adjustment of the position of Z2 relative to Z1, which therefore corresponds to an adjustment of the length Li.

Figure 17:
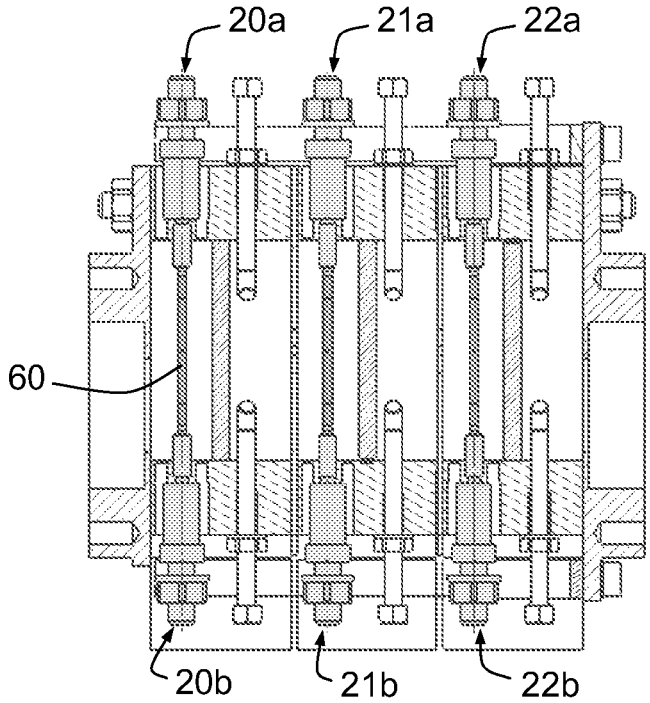
FIG. 17: a diagram in longitudinal cross section of a variant embodiment of the filter of FIG. 10, in which the compensation device has at least two plungers for each cavity and an insert coupling the mobile fingers of all the plungers inserted into one and the same cavity, according to the invention.
Figure 18:
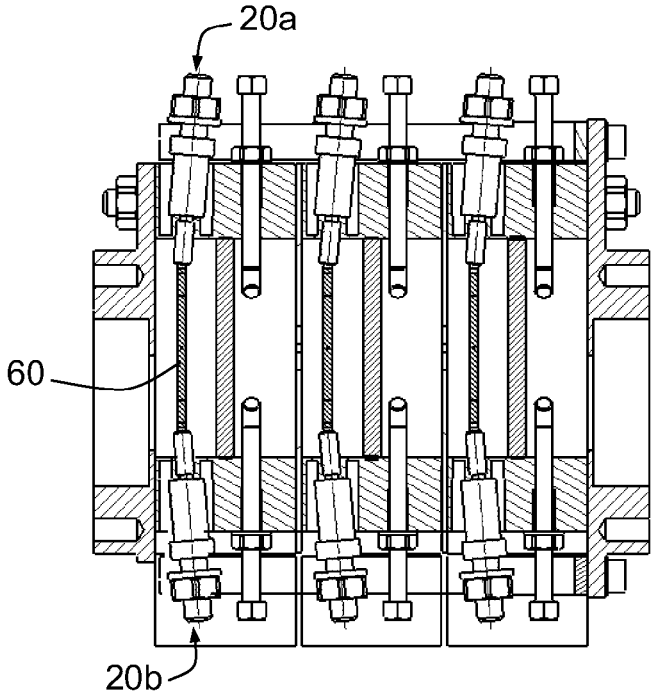
FIG. 18: a diagram in longitudinal cross section of the filter of FIG. 17 when the temperature increases, according to the invention.
Figure 19:
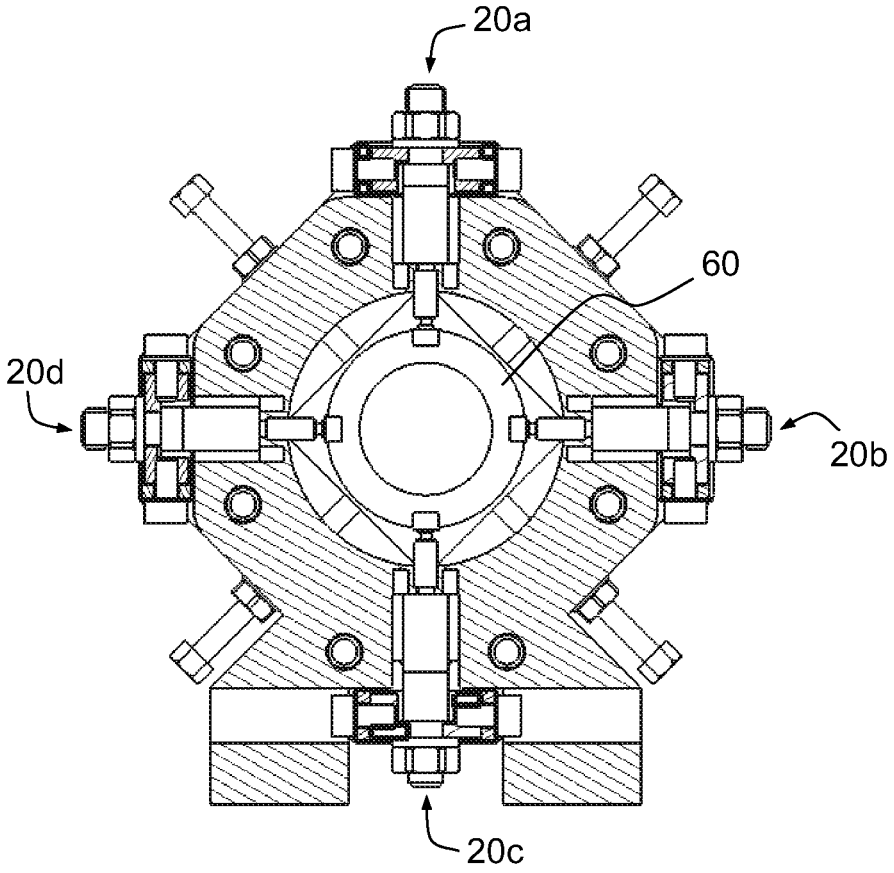
FIG. 19: a diagram in transversal cross section of the filter of FIG. 17, according to the invention.

FIGS. 17, 18, 19 show a variant embodiment of the filter of the invention, in which the compensation device has at least two plungers for each cavity and also has an insert coupling all the plungers inserted into one and the same cavity. In FIG. 19, four mobile fingers 20*a*, 20*b*, 20*c*, 20*d* are inserted into one and the same cavity and the insert 60 which links the four plungers of the four mobile fingers is of annular shape. When, under the effect of the temperature, the plungers of the mobile fingers incline, the insert is displaced laterally and parallel to the resonator placed in the cavity. The insert thus makes it possible to increase the volume of substance which is displaced in the cavity when the temperature varies and makes it possible to obtain a frequency compensation of greater amplitude. The insert 60 therefore makes it possible to increase the compensation amplitude produced by the plungers when the angular displacement of the plungers alone is insufficient. The insert may be made of a dielectric or metallic material. Preferably, the insert is made of the same material as the material of the plungers of the mobile fingers.

Although the invention has been described in association with particular embodiments, it is obvious that it is no way limited thereby and that it includes all the technical equivalents of the means described and their combinations if they fall within the framework of the invention.

The invention claimed is:

1. A microwave filter with a dielectric resonator having a longitudinal axis Z, comprising:

at least one resonant cavity according to at least one resonance mode and at least one resonance frequency, the cavity being delimited by at least one longitudinal wall and transversal walls, the longitudinal and transversal walls being made of a material that has a non-zero expansion coefficient;

the dielectric resonator mounted in the at least one resonant cavity transversally to the axis Z, the dielectric resonator not being temperature compensated or being partially temperature compensated;

a mechanical device for compensating the resonance frequency of the at least one resonant cavity as a function of a temperature, wherein the mechanical compensation device having at least one rotationally mobile finger for each resonance mode, the mobile finger being provided with a plunger penetrating into the at least one resonant cavity to a fixed depth and at a distance D from the resonator, the distance D being defined at ambient temperature and being temperature-variable, at least one pivot link formed in the longitudinal wall, the plunger penetrating into the cavity via the pivot link, and and an external mechanical actuator for controlling a rotation of the mobile finger by pivoting around the at least one pivot link, the actuator being made of a material that has a coefficient of thermal expansion at least five times lower than that of the walls of the filter and being mounted parallel to the axis Z at a non-zero height H from the longitudinal wall of the filter and mechanically coupled to an external top part of the mobile finger.

2. A microwave filter according to claim 1, wherein the mobile finger has an angle of rotation which is a function of the temperature and of the coefficient of thermal expansion difference between the material of the actuator and the material of the longitudinal wall of the filter.

3. A microwave filter according to claim 2, wherein the mobile finger has the top part mounted to abut on a locally thinned region of the longitudinal wall of the filter, the locally thinned region forming the pivot link for the mobile finger.

4. A microwave filter according to claim 2, wherein the mobile finger has the top part mounted to abut on a conductive flexible insert formed in the longitudinal wall of the filter and connected to the mobile finger and to the longitudinal wall, the insert forming the pivot link for the mobile finger.

5. A microwave filter according to claim 3, wherein said at least one resonant cavity has a single resonant cavity and wherein the external mechanical actuator is mechanically coupled, at two attachment points, to the external top part of the mobile finger and to one of the walls of said microwave filter.

6. A microwave filter according to claim 3, further comprising:

the at least one resonant cavity includes at least two resonant cavities superposed along the longitudinal axis Z and coupled together, and the dielectric resonator includes two dielectric resonators respectively mounted in the cavities, wherein the at least one rotationally mobile finger comprises at least two mobile fingers aligned parallel to the axis Z, each mobile finger being provided with a plunger respectively penetrating into the cavities to a fixed depth and at one and the same distance D from the respective dielectric resonators, wherein the external mechanical actuator is mechanically coupled to the external top part of the at least two mobile fingers at two attachment points.

7. A microwave filter according to claim 3, further comprising:

the at least one resonant cavity includes at least two resonant cavities superposed along the longitudinal axis Z and coupled together, and the dielectric resonator includes two dielectric resonators respectively mounted in the cavities, wherein the at least one rotationally mobile finger comprises at least two mobile fingers aligned parallel to the axis Z, each mobile finger being provided with a plunger penetrating respectively into the cavities to a fixed depth and at one and the same distance D from the respective dielectric resonators, wherein the device for compensating frequency variations as a function of the temperature includes an additional longitudinal part made of a material that has the same coefficient of thermal expansion as that of the walls of the filter, the additional longitudinal part being mounted parallel to the external mechanical actuator and fixed to the external top part of the at least two mobile fingers, the external mechanical actuator being fixed to one of the walls of the filter, and wherein the actuator and the additional longitudinal part are mechanically coupled together at a single local fixing point.

8. A microwave filter according to claim 6, wherein the local fixing point has an adjustable longitudinal position.

9. A microwave filter according to claim 6, wherein the external mechanical actuator is fixed to one of the transversal walls of the filter.

10. A microwave filter according to claim 1, further comprising a height H adjustment system to adjust a temperature-variable rotation angle of the plungers and therefore the compensation.

11. A microwave filter according to claim 1, further comprising the at least one rotationally mobile finger includes at least two mobile fingers, the two mobile fingers being distributed angularly through the longitudinal wall of the filter, and comprising at least one insert arranged in the resonant cavity coupling the plungers of the two mobile fingers inserted into the resonant cavity.

12. A microwave filter according to claim 1, wherein the mobile finger is a single-piece part.

13. A microwave filter according to claim 1, wherein the mobile finger has two distinct metal parts.

14. A microwave filter according to claim 1, wherein the mobile finger has two distinct parts, respectively metal and dielectric.

* * * * *